US005272905A

United States Patent [19]

Parlow et al.

[11] Patent Number: 5,272,905

[45] Date of Patent: Dec. 28, 1993

[54] EXTERIOR MANDREL FOR MULTIAXIS BENDER

[75] Inventors: Peter M. Parlow, St. Clair; Jeffrey A. Tibbenham, Farmington Hills; Emery J. Madach, Troy, all of Mich.

[73] Assignee: General Motors Corporation, Detroit, Mich.

[21] Appl. No.: 944,612

[22] Filed: Sep. 14, 1992

[51] Int. Cl.[5] ..... B21D 9/01

[52] U.S. Cl. ..... 72/466; 72/166; 72/169

[58] Field of Search ..... 72/466, 465, 166, 169, 72/171, 150; 269/287, 166–170

[56] References Cited

U.S. PATENT DOCUMENTS

| | | | |
|---|---|---|---|
| 174,609 | 3/1876 | Wright | 72/465 |
| 592,972 | 11/1897 | Leonard . | |
| 1,351,472 | 8/1920 | Farmer | 72/171 |
| 2,390,274 | 12/1945 | Rose et al. | 153/56 |
| 2,425,800 | 8/1947 | Hamilton, Jr. | 153/32 |
| 2,844,058 | 7/1958 | Fasano | 72/465 |
| 2,962,077 | 11/1960 | Condiff | 72/150 |
| 3,415,107 | 12/1968 | Ruscitti | 72/466 |
| 3,844,546 | 10/1974 | Greenberg | 269/287 |
| 4,391,116 | 7/1983 | Yogo | 72/168 |
| 4,719,786 | 1/1988 | Martell | 72/465 |
| 4,744,233 | 5/1988 | Trudell | 72/150 |

FOREIGN PATENT DOCUMENTS

| | | | |
|---|---|---|---|
| 393003 | 8/1973 | U.S.S.R. | 72/466 |

*Primary Examiner*—Daniel C. Crane
*Attorney, Agent, or Firm*—Patrick M. Griffin

[57] ABSTRACT

A tube support mandrel for use with a multiaxis tube bender acts to support the outer surface, rather than the inner surface, of the tube, and so may be used with tubes that are open on one side, or which otherwise do not have a complete, enclosed interior. In the disclosed embodiment, the mandrel includes a stack of thin steel plates, each of which has a central hole that matches the outer surface of the tube. A partially urethane overmold encases and retains the plates together with the central holes aligned. When the tube is forced through the bender, it passes through the aligned plate holes, which closely confine and support its cross sectional shape while flexing to accommodate the curvature being bent into it.

2 Claims, 2 Drawing Sheets

EXTERIOR MANDREL FOR MULTIAXIS BENDER

This invention relates to multiaxis tube bending in general, and specifically to a tube supporting mandrel that supports the exterior, rather than the interior, of the tube being bent.

BACKGROUND OF THE INVENTION

So called multiaxis tube benders are finding increasing use as a rapid and precise means for continuously bending a curvature into a metal tube. Such a bender includes a fixed die and an axially spaced movable die, each of which closely surrounds the exterior cross section of the tube. A powerful drive mechanism forces the tube through both dies as the movable dies swings through a preprogrammed set of motions to bend the tube, relative to the fixed die, into a desired curvature. A typical multiaxis bender may be seen in U.S. Pat. No. 4,391,116.

It is desirable to support the tube cross section against deformation, such as buckling or wrinkling, as it is bent. Generally, an interior bending mandrel is used, such as can be seen in U.S. Pat. No. 3,258,956. Interior mandrels were in use for tube bending long before multiaxis benders existed, but they work well with such machines, at least when the tube to be bent is complete on all four sides. However, when the tube is not complete, but open along one side, or U-shaped in cross section, then an interior mandrel will not work, as it cannot be confined inside the open section. The same is true when the "tube" is not a tube in the conventional sense, but rather a long, thin piece of complex cross section, like an I-beam, which also has no defined, enclosed interior.

SUMMARY OF THE INVENTION

The invention provides a special mandrel, and a method for its manufacture, that allows unconventional tubes of the type described above to be shape supported as they are bent.

The mandrel of the invention is designed to support the exterior, rather than the interior of the tube, and so does not depend on the existence of an enclosed interior in order to work. In the preferred embodiment disclosed, the mandrel includes a series of thin rigid steel plates, each of which has a central hole that matches the shape of the exterior cross section of the tube to be bent. The plates are stacked in a closely, evenly axially spaced array, parallel to one another and with their central holes all aligned. Then, the stack is overmolded with a urethane material, which flows around and between the plates, but is blocked out of the aligned central holes. When cured, the urethane keeps the rigid plates spaced apart and aligned, but allows them to flex slightly relative to one another, in all directions, both bending and twisting. The finished mandrel is located between the fixed and movable dies, and one end can be anchored to the fixed die.

In operation, the urethane overmold allows the mandrel as a whole to bend with and conform to the curvature of the tube. As the tube slides through, the aligned central holes of the rigid plates, being closest to the central, neutral axis, depart less from their unflexed location that does the rest of the mandrel. Being closely spaced, the perimeters of the plates' central holes effectively form a nearly continuous support for the exterior surface of the moving tube, supporting it against wrinkling and other deformation as it is bent. Even if the tube has an open section, the mandrel works, because of its exterior conformation.

It is, therefore, a general object of the invention to provide a tube bending mandrel that can support the cross sectional shape of a tube that does not have an enclosed, complete interior surface.

It is another object of the invention to provide such a mandrel that works to support the exterior, rather than the interior, of the tube that is being bent.

It is another object of the invention to provide such a mandrel that has a series of closely axially spaced rigid plates, each of which has a central hole shape matched to the tube, which plates are flexibly retained together in such a way as to allow the mandrel to conform to the bending tube, but to keep the central plate holes sufficiently aligned that they can hold the cross sectional shape of the tube.

It is still another object of the invention to provide a method for making such a mandrel.

DESCRIPTION OF THE PREFERRED EMBODIMENT

These and other objects and features of the invention will appear from the following written description, and from the drawings, in which.

Figure 1:
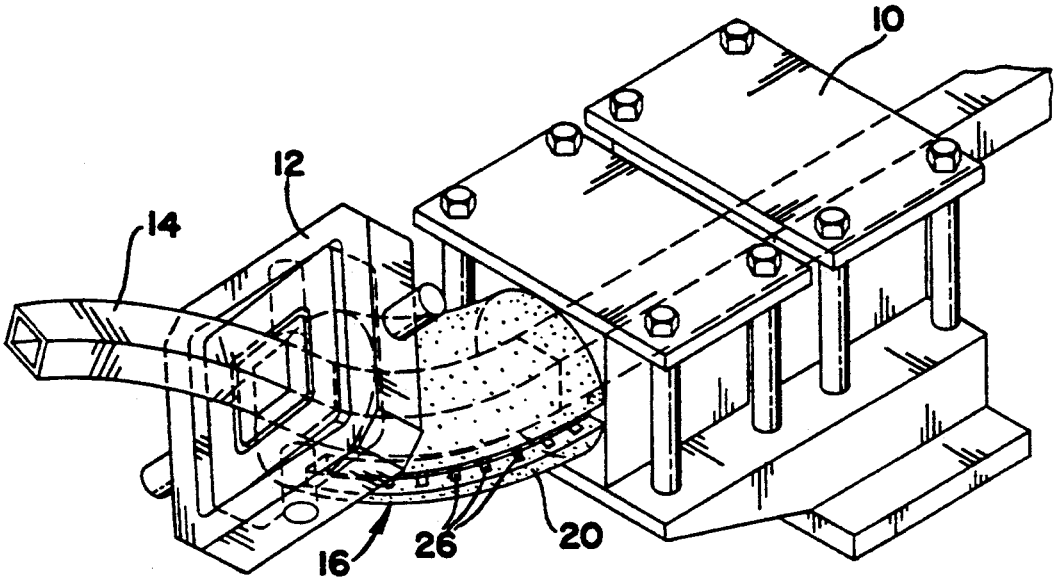
FIG. 1 is a perspective view of just the fixed and movable dies of a multiaxis tube bending machine showing a tube in the process of being bent while supported by a mandrel made according to the invention.

Referring first to FIG. 1, a multiaxis tube bending machine of the type referred to above includes a fixed die (10) and a movable die (12), which is supported for preprogrammed swinging motion by a complex series of yokes, which are not illustrated for purposes of simplicity. What is relevant to the invention here is the fact that a tube (14) is bent into a predetermined curvature within the axial space between the fixed die (10) and movable die (12), a curvature that may be fairly tight. As a consequence, the cross sectional shape of tube (14) is potentially subject to deformation, wrinkling and buckling, if it is not somehow supported. The tube (14) illustrated is a square cross sectioned tube, which has a completely enclosed interior. However, it could just as easily be open on one side, with a C- or U-shaped cross section, or have some other more complex cross sectional shape with no real interior into which a conventional, internal mandrel could be inserted.

Figure 2:
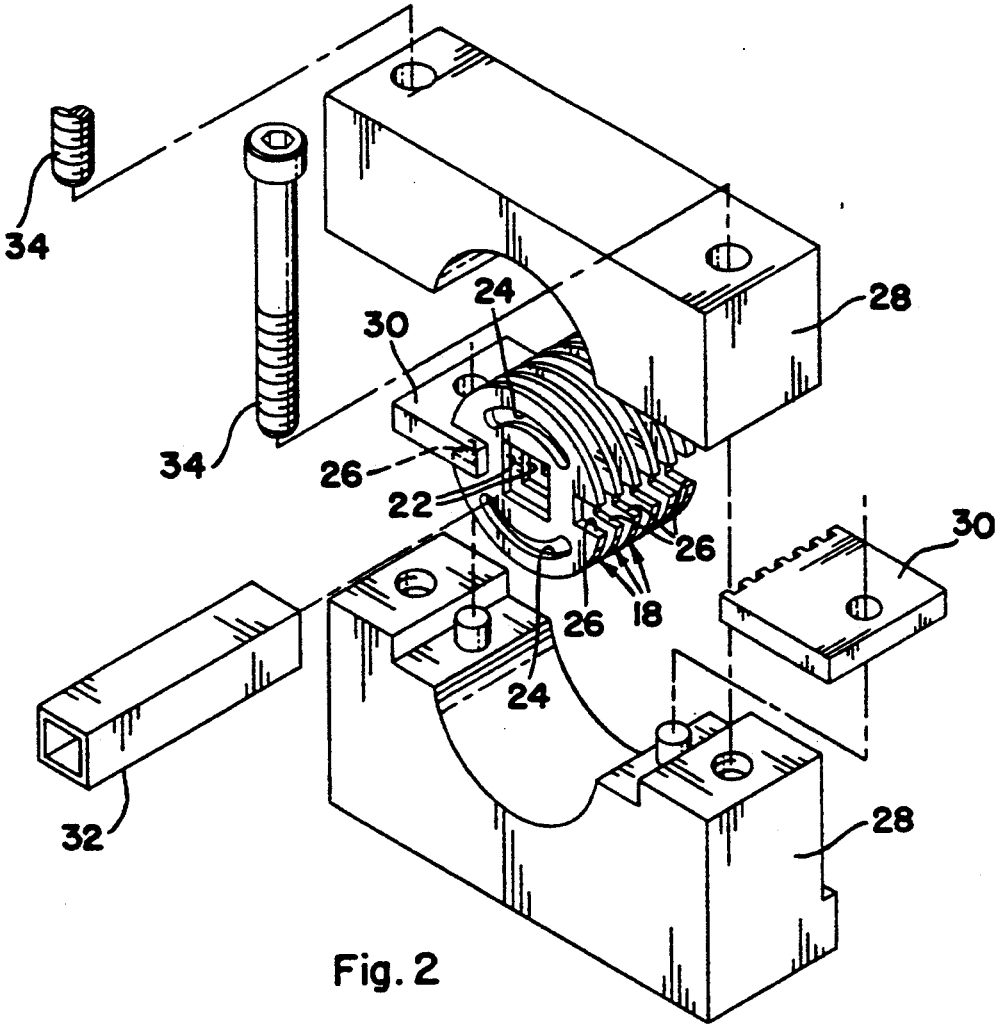
FIG. 2 is an exploded perspective view of part of the mold used to make the mandrel of the invention.
Figure 3:
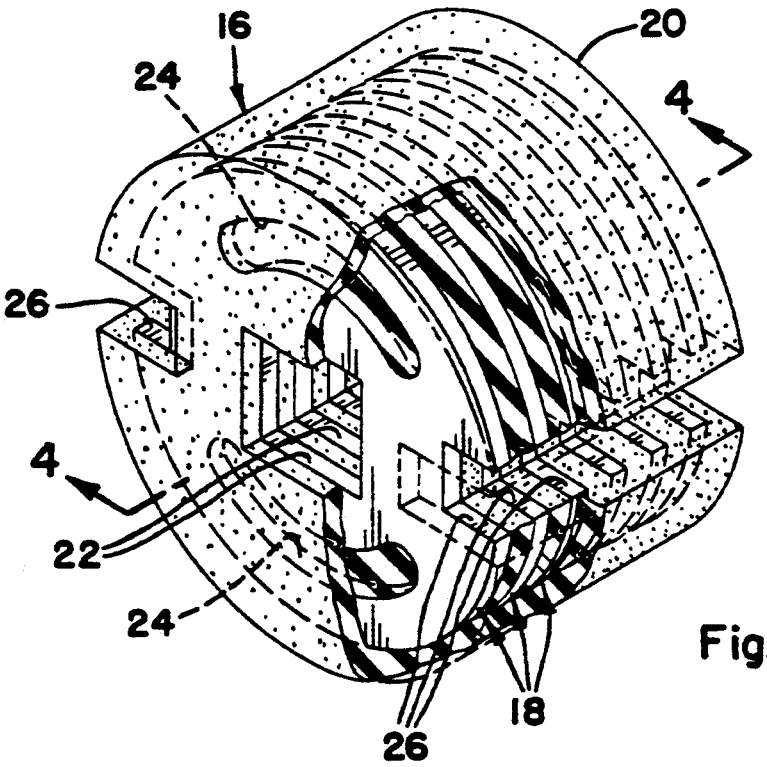
FIG. 3 is a partially broken away perspective view of a mandrel.

Referring next to FIG. 3, the mandrel of the invention, a preferred embodiment of which is indicated generally at (16), includes two basic constituents, a series of identical, thin rigid steel plates (18), which are surrounded by and embedded in an overmold of urethane (20). Each plate (18), as best seen in FIG. 2, is generally round, with a central square hole (22), the perimeter of which matches the shape of the outer surface of tube (14). As such, each plate (18) is adapted to make a close, but not binding, slip fit over tube (14). Above and below each central hole (22), an arcuate slot (24) is cut through each plate (18), and, directly to either side of hole (22), a square side notch (26) is cut. The construction of mandrel (16) is best understood in terms of its method of manufacture, described next.

Figure 4:
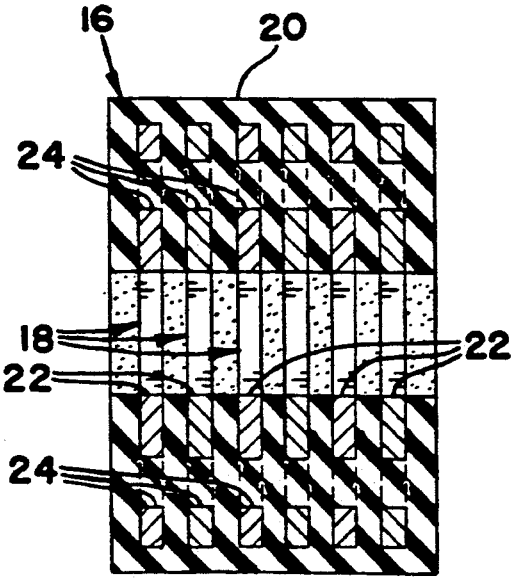
FIG. 4 is a sectional view of a mandrel taken along the line 4—4 of FIG. 3.

Referring next to FIGS. 2 and 4, a molding apparatus includes upper and lower yoke-shaped molds (28), which surround the outer edges of the plates (18), and a pair of toothed spacers (30) that clamp between the sides of the molds (28). The toothed spacers (30) fit into the aligned side notches (26) and between the plates (18) to hold them parallel and spaced apart by approximately their own thickness, as best shown in FIG. 4. The spacers (30) and notches (26) also serve to keep the central holes (22) and arcuate slots (24) aligned. A short length of tube (32) that matches tube (14) is provided, just long enough to fill the space occupied by the aligned central plate holes (22). When the plates (18) are stacked as shown in FIG. 2, they cover a length substantially equal to the axial space between the fixed die (10) and movable die (12). After the molds (28) are clamped down over the spacers (30) and around the stacked plates (18) with bolts (34), and after short tube (32) is inserted, the urethane overmold (20) is injected into and around the plates (18). It flows into and through the aligned arcuate slots (24), and around the outer edges of and into the gaps between the plates (18), but does not fill the blocked central holes (22) or the side notches (26).

Referring next to FIGS. 3 and 4, the structure that results from the molding process described above is similar to a spinal column, with the plates (18) corresponding to vertebrae and the urethane overmold (20) corresponding to connective tissue. The plates (20) are held together, to an extent, by the adhesion of the urethane overmold (20) between them, and by the encasement of their outer edges. Even more retention is provided by that portion of the overmold (20) that runs through the aligned arcuate slots (24), which serves the function that a stringer or wire cable would. Urethane is a plastic material which, while somewhat flexible, is very tough, durable, and resilient, both in compression and tension. As a consequence, the plates (18) are kept spaced apart, and the central holes (22) are kept aligned, so that their perimeter edges, and the intervening layers of the urethane overmold (20), form a tunnel through mandrel (16). That central tunnel is not completely rigid, because of the limited flexibility provided by the overmold (20), but its inner surface is basically constant in shape. Despite the rigidity of the constituent plates (18), mandrel (16) is flexible, to an extent, in all directions, including torsion or twisting. The layers of overmold (20) between the plates (18) allow them to tip or twist relative to one another, to a limited, but sufficient, degree. Mandrel (16) is far from floppy, however, and it would take some force to flex it.

Referring again to FIG. 1, the operation of mandrel (16) is illustrated. Mandrel (16) substantially fills the space between the dies (10) and (12) and can, if desired, be anchored to the fixed die (10). Tube (14) slides through the tunnel formed by the aligned plate central holes (22) as it is forced along its central axis through the dies (10) and (12). Tube (14) is bent under more than sufficient force to flex mandrel (16) along with it as it is bent into the desired curvature. The square, symmetrical tube (14) illustrated has a neutral axis coincident with its central axis. When tube (14) is being bent up or down, which is often the main component of the bending taking place, the two side channels left by the aligned side notches (26) add enhanced flexibility to mandrel (16), since they lie in a plane that includes the central neutral axis and is perpendicular to the main direction of bending. As it moves, the outer surface of tube (14) is closely confined inside the rigid perimeter of each square hole (22). The tunnel provided through mandrel (16) by the substantially aligned holes (22) protects the outer surface of tube (14) from wrinkling and buckling. This would be true whatever the shape of tube (14), and even if it had an open side. Unlike a conventional internal mandrel, mandrel (16) need not rely on a completely enclosed tube to confine it. Instead, it acts as the confining and limiting medium. In fact, mandrel (16) could be used independently of, and in conjunction with, a conventional internal mandrel, in which case the section of tube (14) being bent would be extremely well supported and confined, inside and out.

Variations in the disclosed embodiment would be possible. Any shape central hole could be provided in the plates (18), so as to conform to the outer surface of any shape tube. Moldable plastic materials other than urethane could be used for the overmold (20), so long as they were sufficiently flexible and durable. Some other means could be provided to keep the plates (18) retained together and spaced apart, but which still gave them limited relative flexibility. For example, the plates (18) could be strung together on two or more steel cables to provide retention, with separate urethane pads or washers clamped between the plates (18) to provide spacing and flexibility. This would avoid the molding process, but the process is not difficult, and the resulting overmold (20) can provide all the functions that steel stringers and separate flexible spacers would. Some other means could be used to keep the plates (18) fanned out in the spaced pattern of FIG. 2, such as slots in the inner surface of the molds (28). This would avoid the need for the toothed spacers (30) and the plate side notches (26). However, as noted, the two channels created by the aligned plate side notches (26) and the toothed spacers (30) are particularly useful, since they provide added flexibility in an advantageous location. Therefore, it will be understood that it is not intended to limit the invention to just the embodiment disclosed.

The embodiments of the invention in which an exclusive property or privilege is claimed are defined as follows:

1. For use with a tube bending machine in which a tube having a predetermined exterior cross section and central axis is continuously pushed under force along its axis through an axially spaced fixed die and movable die in order to continuously bend a curvature into said tube, a flexible, self-supporting mandrel for maintaining the exterior shape of said tube as it is bent, comprising:

a plurality of thin rigid plates, each having a central hole with an inner perimeter that matches the exterior cross section of said tube so that said tube may be received through said aligned central holes, and having an outer perimeter, flexible spacing and retention means located clear of said central holes to retain said plates together generally parallel to one another with their central holes aligned along said central axis and covering a length comparable to the space between said dies, said means being just sufficiently flexible to allow said rigid plates to flex enough relative to one another to accommodate the curvature to be bent into said tube, while still maintaining said central holes substantially aligned, said means being a one-piece element and having a portion which both continuously extends through said plurality of said plates so that all said plates are integrally connected by said portion and surrounds the outer and inner perimeters of said plurality of plates, whereby said mandrel may be located between said spaced dies with said tube sliding through said aligned central holes as said tube is forced through and bent by said dies, said rigid plates supporting the exterior cross section of said tube against wrinkling as said mandrel flexes with said tube.

2. For use with a tube bending machine in which a tube having a predetermined exterior cross section and central axis is continuously pushed under force along its axis through an axially spaced fixed die and movable die in order to continuously bend a curvature into said tube, a flexible self-supporting mandrel for maintaining the exterior shape of said tube as it is bent, comprising:

a plurality of thin rigid plates, each having a central hole with an inner perimeter that matches the exterior cross section of said tube so that said tube may be received through said aligned central holes having an outer perimeter, and, an overmold of resilient material molded around and between said plates so as to retain them together generally parallel to one another with their central holes aligned along said central axis and covering a length comparable to the space between said dies, said resilient overmold being just sufficiently flexible to allow said rigid plates to bend and twist sufficiently relative to one another about said central axis to accommodate the curvature to be bent into said tube, while still maintaining said central holes substantially aligned, said resilient material being a one-piece element and having a portion which both continuously extends through said plurality of said plates so that all said plates are integrally connected by said portion and surrounds the outer and inner perimeters of said plurality of plates, whereby said mandrel may be located between said spaced dies with said tube sliding through said aligned central holes as said tube is forced through and bent by said dies, said rigid plates thereby supporting the exterior cross section of said tube against wrinkling as said mandrel flexes with said tube.

* * * * *